US006545581B1

(12) United States Patent
Munsch et al.

(10) Patent No.: US 6,545,581 B1
(45) Date of Patent: Apr. 8, 2003

(54) IGNITION UNIT FOR AT LEAST TWO SPARKPLUGS OF AN INTERNAL COMBUSTION ENGINE

(75) Inventors: Thierry Munsch, Villette d'Anthon (FR); Raphaël Monavon, Villeurbanne (FR)

(73) Assignee: L'Electricfil Industrie, Miribel (FR)

( * ) Notice: Subject to any disclaimer, the term of this patent is extended or adjusted under 35 U.S.C. 154(b) by 0 days.

(21) Appl. No.: 09/714,816

(22) Filed: Nov. 17, 2000

(30) Foreign Application Priority Data

Nov. 19, 1999 (FR) ..... 99 14611

(51) Int. Cl.[7] ..... H01F 27/02

(52) U.S. Cl. ..... 336/90; 336/90; 336/96; 123/634; 123/635; 29/606

(58) Field of Search ..... 336/90, 96, 226, 336/107, 110, 165, 178; 29/605, 606, 609

(56) References Cited

U.S. PATENT DOCUMENTS 4,706,638 A * 11/1987 Johansson et al. ..... 123/647
5,003,959 A * 4/1991 Umezaki et al. ..... 123/647
5,125,386 A * 6/1992 De Filippis et al. ..... 123/634
5,685,065 A * 11/1997 Suzuki et al. ..... 29/606
5,692,483 A * 12/1997 Wada et al. ..... 123/634

* cited by examiner

*Primary Examiner*—Elvin Enad
*Assistant Examiner*—Jennifer A. Poker
(74) *Attorney, Agent, or Firm*—Dennison, Schultz & Dougherty

(57) ABSTRACT

An ignition unit for at least two sparkplugs of an internal combustion engine, the unit being in the form of a box having therein a reception cavity receiving an electronic printed circuit, a plurality of mutually separate housings extending side by side transversely relative to the reception cavity, a separating partition disposed between the reception cavity and the housings which defines a through opening between each of the housings and the reception cavity, and a plurality of ignition coils, each mounted in a corresponding one of the housings. Each ignition coil is fitted with a primary connector including 1) a fixing member for fixing the ignition coil to the box to enable the ignition coil to be mounted in a corresponding one of the housings, and 2) connection terminals between the ignition coil and the printed circuit. Each fixing member includes a separator panel having connection terminals passing therethrough, with the separator panel being mounted in a corresponding through hole to close the through hole, with the connection terminals contacting the printed circuit.

13 Claims, 3 Drawing Sheets

IGNITION UNIT FOR AT LEAST TWO SPARKPLUGS OF AN INTERNAL COMBUSTION ENGINE

BACKGROUND OF THE INVENTION

The present invention relates to the technical field of internal combustion engines, and more particularly engines with ignition controlled by means of sparkplugs.

The invention relates more particularly to an ignition unit comprising, for each sparkplug of the engine, an electrical coil suitable for taking electrical energy from a low voltage source and for supplying the associated sparkplug with energy at the high voltage required for producing an ignition spark inside a combustion chamber titted with such a sparkplug.

BACKGROUND OF THE INVENTION

Although the ignition systems of such engines initially comprised a single ignition coil with high tension electricity then being distributed from it to each of the sparkplugs via a mechanical or electronic distributor, proposals are known whereby each sparkplug is fitted with an individual ignition coil. The intended purpose of such a proposal is to reduce the lengths of the conductors or cables carrying high voltage energy, thus making it possible to limit the major electrical leaks that impede proper operation of the engine and that also degrade the radio environment of such engine.

It should be assumed that such a "monostatic" ignition unit, i.e. a unit requiring one coil to be implemented for each sparkplug of an engine, possesses the major drawback of presenting large bulk compared with an ignition unit comprising a coil that feeds a plurality of sparkplugs. Unfortunately, the amount of room available around an engine is always restricted.

Furthermore, it should be observed that because it implements a plurality of coils, a monostaic ignition unit requires numerous electrical connections between each coil, specifically its primary and secondary windings, and secondly the controlling and monitoring electronics that is associated with such coils. Such electrical connections lead quite naturally to an increase in the general bulk and the manufacturing costs of such a unit.

SUMMARY OF THE INVENTION

The object of the invention is thus to seek to remedy the drawbacks specified above by proposing an ignition unit for at least two sparkplugs of an internal combustion engine, the unit being designed to present little bulk and low manufacturing cost.

Another object of the invention is to propose an ignition unit designed to enable the electrical connections between the various components of such an ignition unit to be implemented in simple manner and at low cost.

To achieve such an object, the ignition unit for at least two sparkplugs of an internal combustion engine is constituted in the form of a box comprising internally:

- a reception cavity for receiving an electronic printed circuit;
- a series of mutually separate housings extending side by side transversely relative to the reception cavity; and
- a series of ignition coils each fitted with a primary connector comprising firstly a fixing member for fixing the ignition coil to the box to enablle said ignition coil to be mounted in a corresponding housing, and secondly connection terminals between the ignition coil and the printed circuit.

The above described ignition unit is particularly suitable for enabling the box constituting such an ignition unit to be subdivided into two sealed portions, specifically one portion for the coils and a second portion for receiving the controlling electronics. To achieve such an object, the unit comprises:

- a separating partition between the reception cavity and the housings, the separating partition leaving a through opening between each housing and the reception cavity;
- as the fixing member for each primary connector, a separator panel having connection terminals passing through it, the panel being for mounting in the operating partition to close the corresponding through opening;
- an electrically insulating potting compound of a first type filling the reception cavity for the printed circuit; and
- an electrically insulating potting compound of a second type filling the housings.

BRIEF DESCRIPTION OF THE DRAWINGS

Other characteristics appear from the following description made with reference to the accompanying drawings which show embodiments and implementations of the invention by way of non-limiting example.

DETAILED DESCRIPTION OF THE INVENTION

Figure 1:
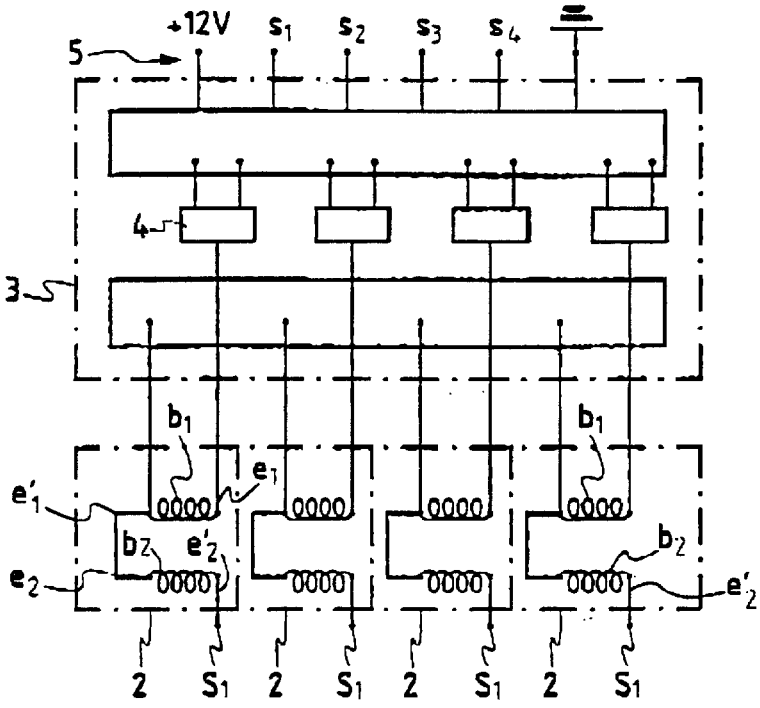
FIG. 1 is a functional circuit diagram of an ignition unit in accordance with the invention.

As can be seen more precisely in FIG. 1, the monostatic type unit 1 is adapted to provide the ignition of at least two, and in the example shown, of four sparkplugs of an internal combustion engine. In conventional manner, a monostatic ignition unit 1 comprises, for each sparkplug, an ignition coil 2, i.e. four such blocks in the example shown. Each ignition coil 2 is designed to deliver high voltage energy on an output $S_1$. The ignition coils 2 are connected in conventional manner to an electronic circuit 3 having various eletronic components such as power transistors 4. Such an electronic printed circuit 3 is connected to a low voltage connector 5 for connection, for example, to ground, to a power supply voltage (+12 volts), and to one or more control circuits ($s_1$ to $s_4$).

Figure 2:
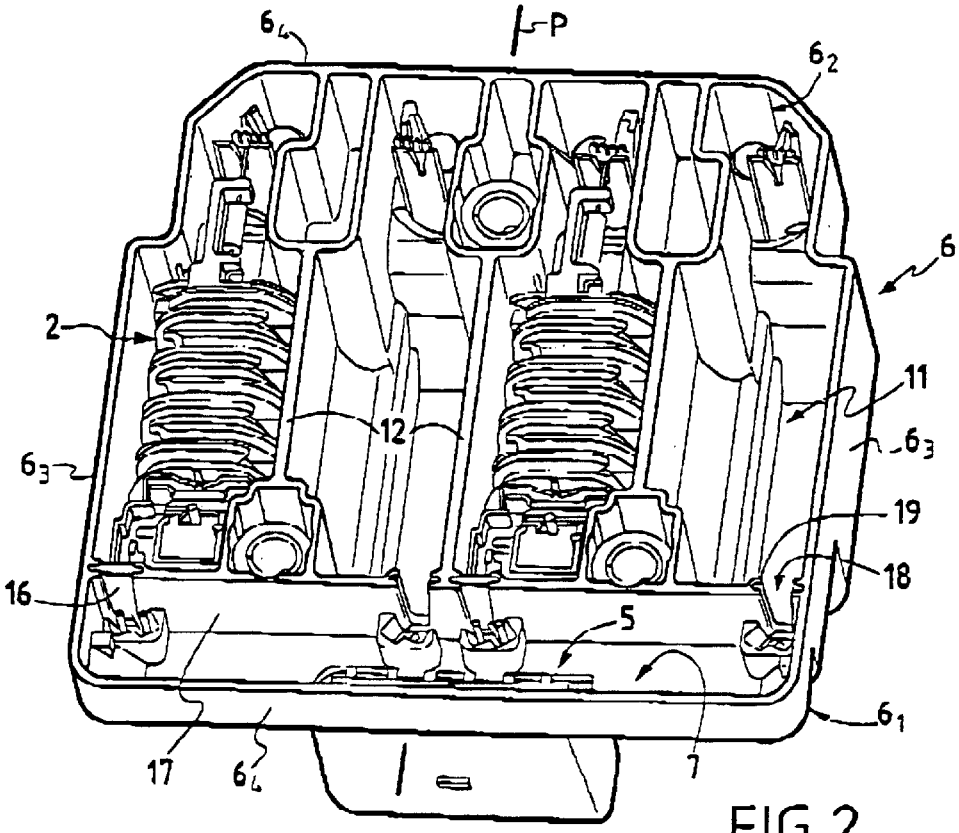
FIG. 2 is a fragmentary perspective view of an ignition unit in accordance with the invention.

As can be seen more precisely in FIG. 2, the ignition unit 1 of the invention is constituted in the form of a box 6 e.g. made by injecting a plastics material. The box 6 is generally in the form of a rectangular parallelepiped having a bottom-forming main face $\mathbf{6}_1$ and an opposite main face $\mathbf{6}_2$ that is open. The box 6 is defined by two longitudinal sides $\mathbf{6}_3$ opposite each other and by two transverse sides $\mathbf{6}_4$ likewise opposite each other. The box 6 has a plane of symmetry P that is substantially parallel to its longitudinal sides $\mathbf{6}_3$. The box 6 is arranged to include a cavity 7 extending transversely relative to the plane of symmetry P from one longitudinal side $\mathbf{6}_3$ to the other, and occupying little depth in the plane P. The cavity 7 is adapted to receive the electronic printed circuit 3 and is provided with the low voltage connector 5.

In accordance with the invention, the box 6 has a series of housings 11 each adapted to receive an ignition coil 2, only two of which are shown in FIG. 2. In the embodiment shown, the box 6 has four housings 11 that are separated from one another by walls 12 substantially parallel to the plane of symmetry P. The housings 11 thus extend side by side substantially parallel to the plane of symmetry P from one longitudinal side $\mathbf{6}_3$ to the other, i.e. transversely relative to the cavity 7.

Figure 3:
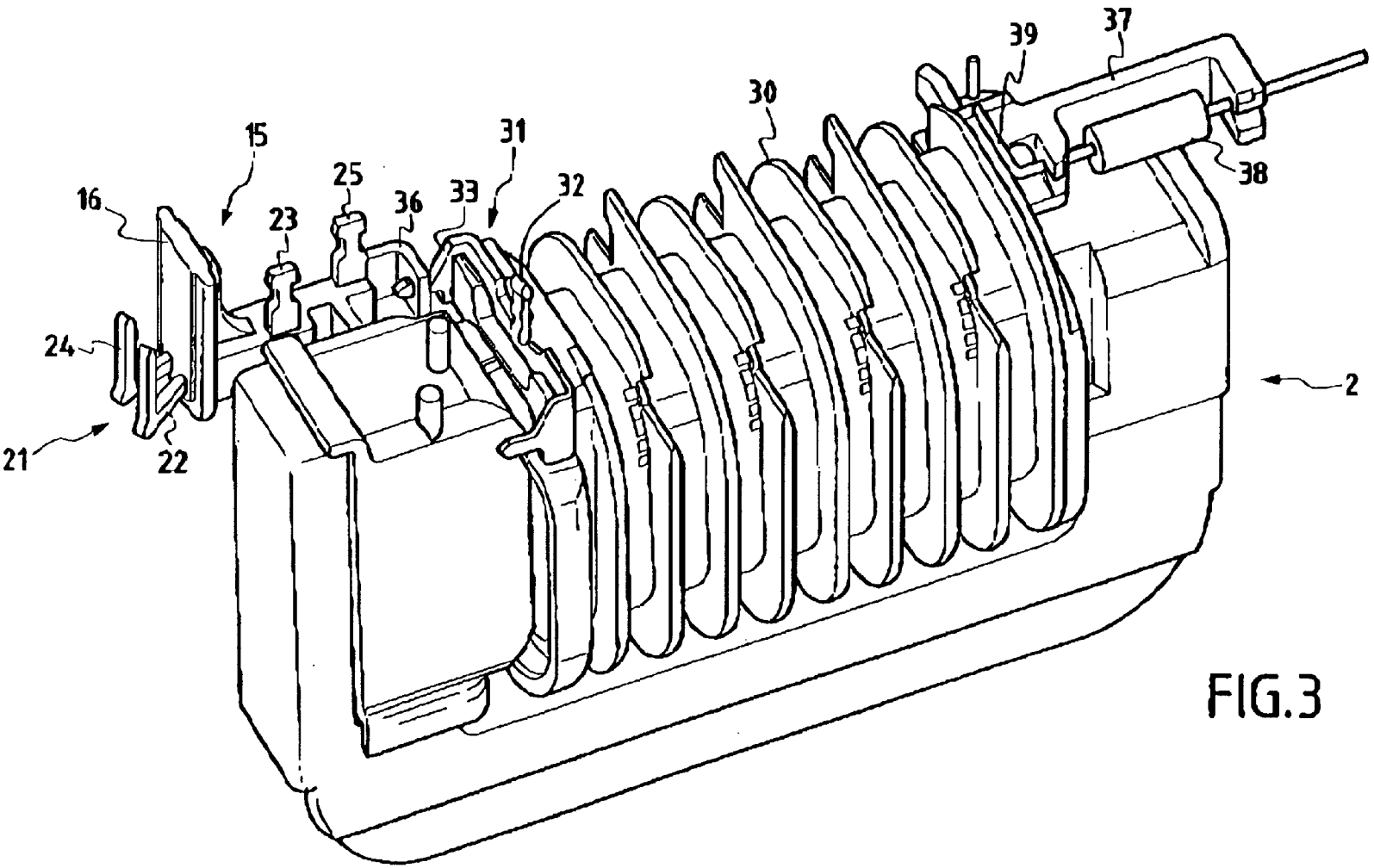
FIG. 3 is a perspective view of an embodiment of an ignition coil in accordance with the invention.
Figure 4:
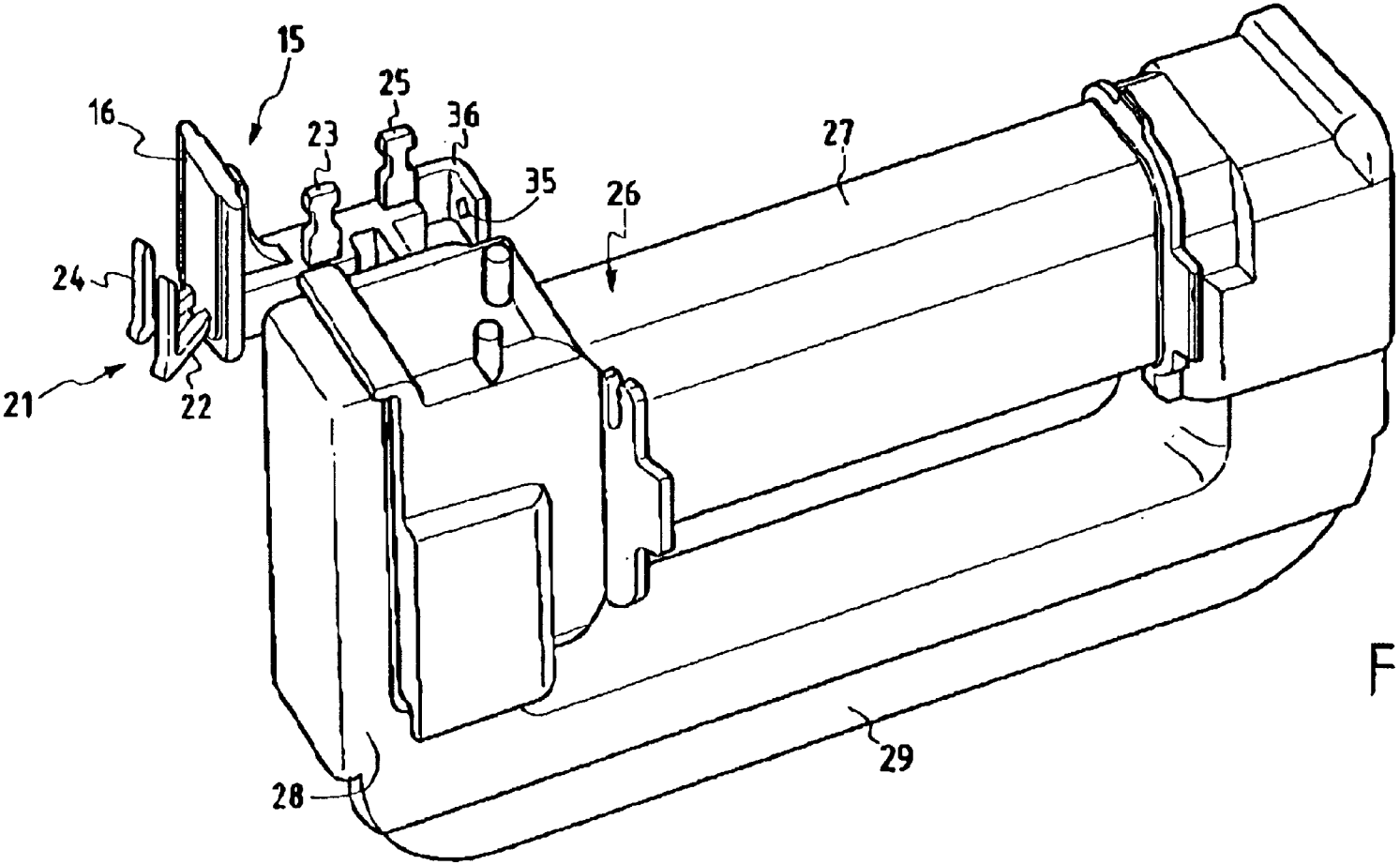
FIG. 4 is a perspective view of a portion of the ignition coil shown in FIG. 3.

As can be seen more precisely in FIGS. 3 and 4, each ignition coil 2 is fitted with a primary connector 15 for electrical connection with the electronic printed circuit 3 and for positioning the ignition coil 2 inside a corresponding housing 11. Each primary connector 15 includes a fixing member 16 adapted to be mounted on the box 6 in order to fix the ignition coil 2 to the box 6, and position it inside a housing 11.

In a preferred embodiment, each fixing member 16 is mounted on a separating partition 17 to have the cavity 7 on one of its sides and the end of one of the housings 11 on its other side, with the other ends of the housings 11 being defined by the transverse side $\mathbf{6}_4$ opposite from the transverse side defining the cavity 7. This separating partition 17 extends substantially parallel to the transverse sides $\mathbf{6}_4$ between the two longitudinal sides $\mathbf{6}_3$. In this preferred embodiment, the separating partition 17 is provided with through openings 18 providing communication between each of the housings 11 and the cavity 7. In addition, the fixing member 16 is shaped in the form of a separator panel adapted to be received in slideways 19 on either side of each through opening 18. In this embodiment, each separator panel 16 thus closes a corresponding through opening 18 so that when the ignition coils 2 are in the assembled position, the separating partition 17 and the panels 16 form a sealed separation between the cavity 7 and the housings 11.

In this preferred embodiment, it is advantageous to make use of an electrically insulating potting compound of a first type to fill the cavity 7 that receives the printed circuit 3, and an electrically insulating potting compound of a second type to fill the housings 11, given that there is a sealed separation between the housings 11 and the cavity 7. Such electrically insulating potting compounds (which are not shown in the drawings) thus close the box substantially level with its open face $\mathbf{6}_2$ that can be seen in FIG. 2. The potting compound of the first type filling the cavity 7 for receiving the printed circuit is preferably suitable for conducting heat so as to dissipate the heat produced by the various electronic components.

It should be observed that the separating partition 17 can be omitted, or modified, so that it no longer provides a sealing function while nevertheless continuing to provide an assembly function for the primary connectors 1*b*. In this example, the fixing member 16 could be of a different shape, e.g. for mounting on extensions arranged on the box to form grooves or slideways for receiving the fixing member.

Each primary connector 15 also includes connection terminals 21 passing through the separator panel 16. The connection terminals 21 thus provide an electrical connection between each ignition coil 2 and the printed circuit 3.

In a preferred embodiment, each primary connector 15 comprises, as connection terminals 21:

a first tongue 22 provided on its housing side with a post 23 onto which one end $e_1$ of the wire of a primary winding $b_1$ forming part of the ignition coil is wrapped; and a second tongue 24 provided on its housing side with a post 25 onto which the other end $e'_1$ of the wire of the primary winding $b_1$ is wrapped (FIGS. 1 and 4).

Each primary connector 15 is cantilevered out from a support 26 and together they form a single piece made of dielectric material, e.g. a plastics material. The electrical connections of the primary connector 15 as described above and shown in the electrical circuit diagram of FIG. 1 are provided, for example, by electrical conductors optionally embedded in a plastics material forming the primary connector 15. In the embodiment shown, the support 26 comprises in particular a primary tubular winding body 27 for the primary winding $b_1$ and a protective case 28 for a closed magnetic circuit 29. The closed magnetic circuit 29 is made in any appropriate manner by means of a stack of laminations and optionally includes a plurality of permanent magnets. In the example shown, the magnetic circuit 29 is generally rectangular in shape, and for each branch of the circuit it presents a right cross-section that is in the form of a parallelogram for optimum compactness. In this embodiment of the closed magnetic circuit, the primary tubular body 27 also possesses a right cross-section in the form of a parallelogram analogous to that of the magnetic circuit 29.

The primary tubular body 27 is mounted around one of the branches of the magnetic circuit 29 and serves as a winding support or "former" for the primary winding $b_1$. The primary tubular body 27 is extended at each end by the case 28 which surrounds at least a part of the magnetic circuit 29. The case 28 preferably does not cover completely the branch opposite the branch surrounded by the primary tubular body 27 insofar as said portion that is not covered by the case 28 will be protected by the walls of the box 6 once the ignition coil 2 is in the assembled position.

As can be seen more clearly in FIG. 3, the primary winding $b_1$ is surrounded by a secondary tubular body 30 made of a dielectric material and allowing a secondary winding $b_4$ to be wound. Still for the purpose of achieving compactness, this secondary tubular body 30 has a right cross-section in the form of a parallelogram analogous to the sections of the magnetic circuit 29 and of the primary tubular body 27. Each secondary tubular body 30 is fitted with a secondary connector 31 provided with a wrapping post 32 for one end $e_2$ of the wire of the secondary winding $b_2$. The secondary connector 31 also has at tongue 33 projecting from the secondary tubular body 30 so as to be engaged in an orifice 35 formed in a plate 36 extending from the second tongue 24 provided with the post 25. Each secondary tongue 33 is electrically connected to the wrapping post 32 so that engaging a secondary tongue 33 in a plate 36 serves to establish electrical connection between the post 25 of the primary winding $b_1$ and the end $e_2$ of the secondary winding $b_2$. In addition, each secondary tongue 33 is of a shape that is complementary to that of the orifice 35 so as to serve to hold the secondary tubular body 30 relative to the primary tubular body 27.

At its end remote from the secondary connector 31, the secondary tubular body 30 has a support arm 37 for a diode 38 having one terminal 39 folded so as to constitute a wrapping post for the other end $e'_2$ of the wire of the secondary winding $b_2$. The other terminal of the diode 38 is connected to the output terminal $S_1$ for high voltage energy.

From the above description, it can be seen that making a box 6 for receiving the ignition coils 2 and the printed circuit 3 gives rise to a unit that is compact. The size of such a box is further reduced by the electrical connections serving also to perform a function of mechanically assembling the various components to one another. In addition, the connections for the wires of the primary and secondary windings are relatively simple to make. In addition, in a preferred embodiment, the inside or the box 6 can be subdivided into two sealed portions making it possible to use two potting compounds of different types.

The invention is not limited to the examples described and shown since various modifications can be provided thereto without going beyond its ambit. In this respect, in the embodiment shown, each ignition coil 2 has a secondary winding $b_2$ that surrounds the primary winding $b_1$ concentrically which is in turn mounted on one of the branches of a magnetic circuit. Naturally, the subject matter of the invention can be implemented by ignition coils made differently. Similarly, the number of ignition coils 2 mounted inside the box 6 can be other than four, for example there could be two or six of them.

What is claimed is:

1. An ignition unit for at least two sparkplugs of an internal combustion engine, the unit being in the form of a box comprising therein:

a reception cavity receiving an electronic printed circuit;

a plurality of mutually separate housings extending side by side transversely relative to the reception cavity;

a separating partition disposed between the reception cavity and the housings, the separating partition defining a through opening between each of said housings and the reception cavity; and a plurality of ignition coils, each of said ignition coils being mounted in a corresponding one of said housings, each of said ignition coils being fitted with a primary connector comprising 1) a fixing member for fixing the ignition coil to the box to enable said ignition coil to be mounted in a corresponding one of said housings, and 2) connection terminals between the ignition coil and the printed circuit;

wherein each said fixing member comprises a separator panel having connection terminals passing therethrough, with the separator panel being mounted in a corresponding through hole to close said corresponding through hole, with the connection terminals disposed for contact with the printed circuit.

2. A unit according to claim 1, comprising:

an electrically insulating potting compound of a first type filling the reception cavity for the printed circuit; and an electrically insulating potting compound of a second type filling the housings.

3. A unit according to claim 2, wherein the potting compound of the first type is suitable for conducting heat so as to dissipate the heat produced.

4. A unit according to claim 2, wherein each separator panel is mounted in the separating partition by being engaged slidably on either side of the through opening.

5. A unit according to claim 1, wherein each primary connector comprises, as connection terminals;

a first tongue provided at its housing end with a wrapping post for one end of the wire of a primary winding; and a second tongue provided at its housing end with a wrapping post for the other end of the wire of the primary winding.

6. A unit according to claim 5, wherein the second tongue has a plate provided with an orifice for receiving a secondary tongue electrically connected to one end of the wire of a secondary winding, the secondary tongue extending from a secondary tubular winding body for the secondary winding which is mounted around the primary winding.

7. A unit according to claim 6, wherein the secondary tongue has a wrapping post for one end of the wire of the secondary winding.

8. A unit according to claim 6, wherein the secondary tubular body has an arm supporting a diode having one terminal bent to form a wrapping post for an opposite end of the wire of the secondary winding.

9. A unit according to claim 1, wherein each primary connector extends from a support that includes a tubular winding body for the primary winding.

10. A unit according to claim 9, wherein the tubular winding body for the primary winding is mounted around one of the branches of a closed magnetic circuit.

11. A unit according to claim 10, wherein the primary tubular body is associated with a protective case for the magnetic circuit.

12. A unit according to claim 11, wherein the protective case for the magnetic circuit surrounds at least a portion of said circuit, the remainder of said circuit being protected by the walls of the box.

13. A unit according to claim 10, wherein each of the branches of the magnetic circuit has a right cross-section in the form of a parallelogram.

* * * * *